US005377858A

United States Patent [19]

Morris, Sr.

[11] Patent Number: 5,377,858

[45] Date of Patent: Jan. 3, 1995

[54] SPACE-SAVING RECTANGULAR CONTAINER HAVING CHILD RESISTANT LID ASSEMBLY

[76] Inventor: Glenn H. Morris, Sr., 1192 Cumberland Rd., Chattanooga, Tenn. 37419

[21] Appl. No.: 6,538

[22] Filed: Jan. 21, 1993

[51] Int. Cl.[6] ..... B65D 51/18

[52] U.S. Cl. ..... 220/254; 220/288; 220/306; 220/323; 220/326; 220/601; 220/617; 220/771; 206/506; 206/508; 206/518; 206/519; 215/216

[58] Field of Search ..... 220/254, 288, 306, 324, 220/326, 601, 617, 771, 323; 206/506, 508, 518, 519; 215/216, 217, 218, 219, 220, 221

[56] References Cited

U.S. PATENT DOCUMENTS

| | | | |
|---|---|---|---|
| 2,606,586 | 8/1952 | Hill . | |
| 2,733,052 | 1/1956 | Luther | 220/254 X |
| 3,272,094 | 9/1966 | Carpenter, Jr. | 206/519 X |
| 3,307,602 | 3/1967 | Boster | 220/254 X |
| 3,307,739 | 3/1967 | Cloyd et al. . | |
| 3,866,791 | 2/1975 | Roper et al. | 206/519 X |
| 4,000,839 | 1/1977 | Tecco et al. | 220/254 X |
| 4,288,000 | 9/1981 | Luker et al. | 220/281 |
| 4,718,571 | 1/1988 | Bordner | 220/270 |
| 4,934,554 | 6/1990 | Edwards | 220/306 X |
| 4,967,926 | 11/1990 | Morris, Sr. | 220/323 |
| 4,967,926 | 11/1990 | Morris, Sr. . | |
| 5,046,632 | 9/1991 | Bordner | 220/306 X |
| 5,111,954 | 4/1992 | Gaudreault | 220/266 |
| 5,125,538 | 6/1992 | Morris, Sr. . | |

*Primary Examiner*—Allan N. Shoap
*Assistant Examiner*—Stephen Cronin
*Attorney, Agent, or Firm*—Brady, O'Boyle & Gates

[57] ABSTRACT

A space saving rectangular container having a child resistant lid assembly wherein the rectangular container has a rectangular closure provided with a central opening. The child resistant lid assembly is removably mounted on the closure to close the opening and is positioned inwardly of the container side walls so that when placing a plurality of the containers having child resistant lid assemblies thereon in a stacked or side-by-side relationship, the child resistant lid assembly is positioned inwardly from the side wall of an adjacent container to thereby prevent damage to the lid assembly by the adjacent container during shipment and storage. The side walls of the container are tapered to facilitate nesting with a similar container and the side walls of the containers are provided with a longitudinally extending recess beneath a handle to facilitate sliding the inner container from the outer container when in the nested position, and diagonal webs are provided on the bottom of each container along the peripheral edge portion thereof for centering the container to straddle the top of the lid on the next adjacent lower container, with the bottom of each container engaging reinforced portions on the top of the closure of the next adjacent lower container when stacked.

28 Claims, 4 Drawing Sheets

FIG. 2
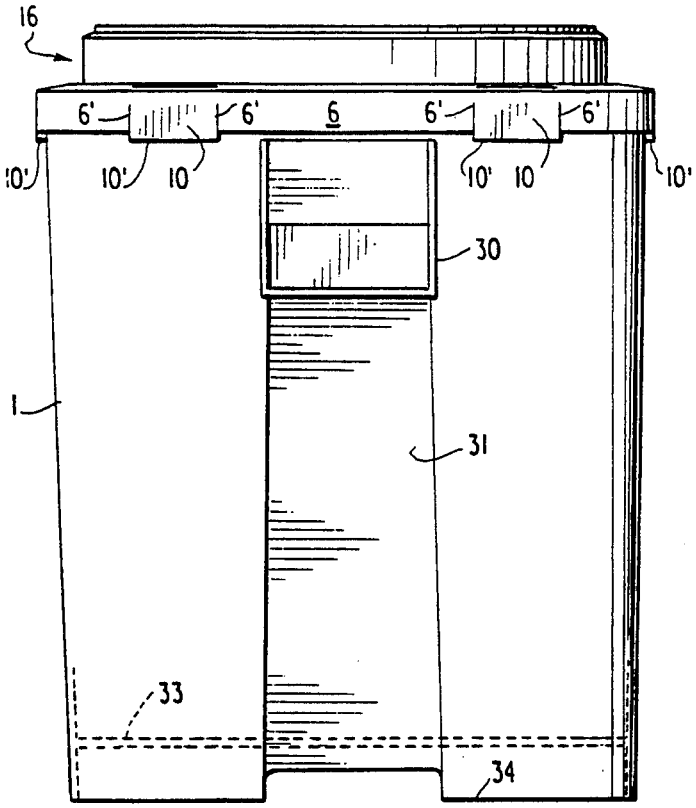
FIG. 7
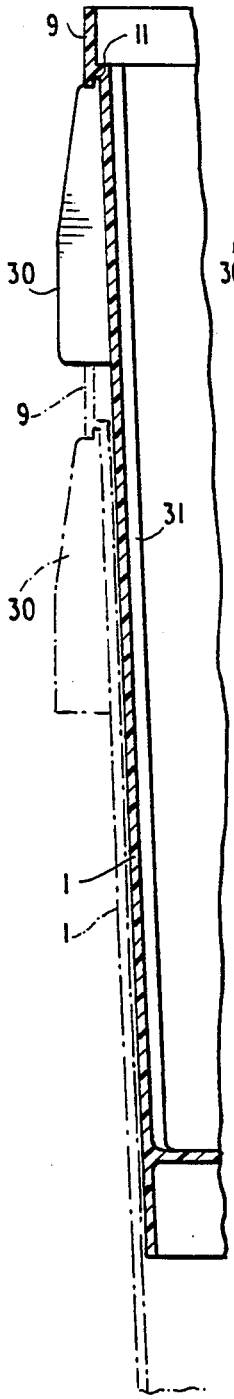
FIG. 8
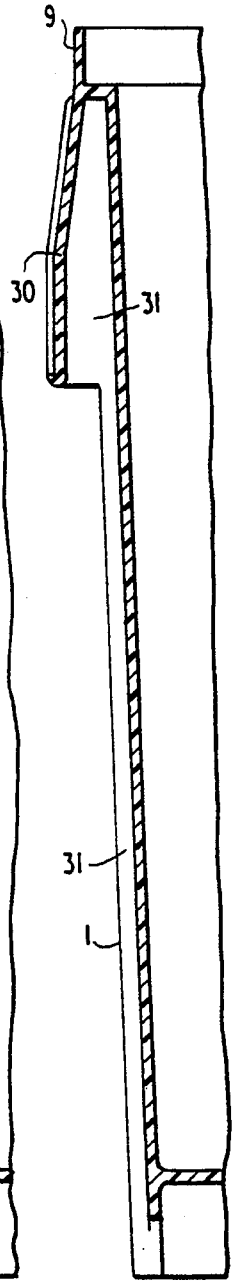
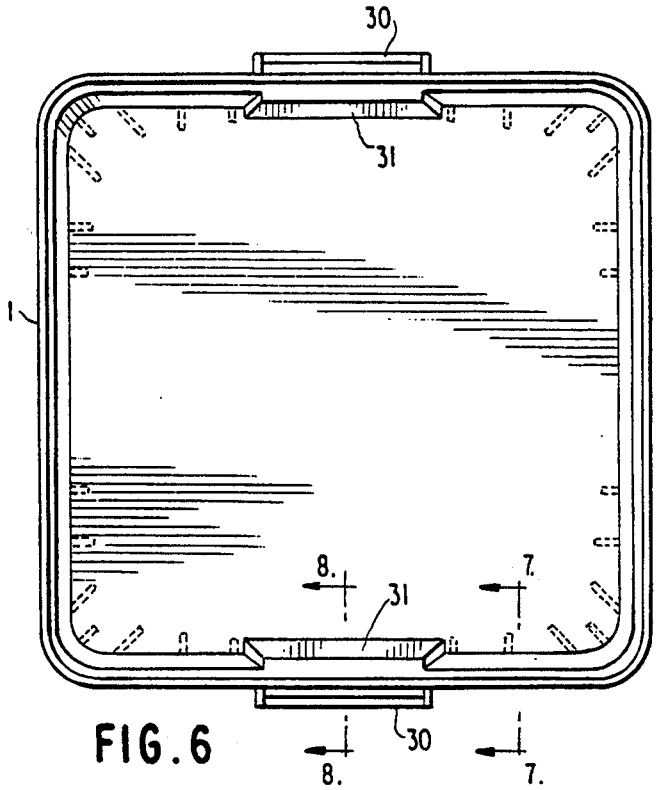
FIG. 6

SPACE-SAVING RECTANGULAR CONTAINER HAVING CHILD RESISTANT LID ASSEMBLY

BACKGROUND OF THE INVENTION

Child resistant lid assemblies for open head cylindrical containers are disclosed in Applicant's U.S. Pat. Nos. 4,967,926 and 5,125,538, wherein a threaded connection is provided between the container and lid and at least one resiliently biased locking member is pivotally connected to the lid which cooperates with locking teeth on the container to secure the lid to the container.

While these child resistant lid assemblies have been satisfactory for their intended purpose, the construction and arrangement of the lid and associate locking member resulted in the lid being connected directly to the upper edge of the container thus being liable to damage by an adjacent abutting container during transportation and storage.

Furthermore, the open head containers upon which the lids and associated locking members are connected are cylindrical, thereby requiring more space for pallet loading and storage than would be required if the containers were rectangular. Rectangular containers for maximizing use of pallet space are disclosed in U.S. Pat. Nos. 2,606,586 and 3,307,739; however, these containers do not include child resistant lid assemblies.

SUMMARY OF THE INVENTION

In order to maximize use of pallet space for transportation and storage, the rectangular container and associated child resistant lid assembly of the present invention have been devised, wherein the container is provided with a rectangular closure snapped onto the upper rectangular edge of the container. The closure is provided with a central circular opening surrounded by a pair of spaced annular walls each having threads formed thereon for engagement by cooperating threads on a lid having a resiliently biased locking member pivotally connected to the lid which engages teeth on the inner surface of the outer annular wall, of the pair of annular walls, to secure the lid to the container closure. By this construction and arrangement, the lids and associated locking members are positioned inwardly of the peripheral edges of the containers so that, when placing the containers in side-by-side relationship, or when stacking the containers, the lid and associated locking member on each container are spaced inwardly from the side wall of the adjacent container thereby preventing damage to the lid and associated locking member by the adjacent container during shipment and storage.

Short diagonal side webs are provided along the peripheral edge portion on the bottom of each container for centering the container on top of the lid on the next adjacent lower container when stacking.

Hand grips are integral with two side walls of the container which are tapered to facilitate nesting of plural containers when empty, the two side walls also having longitudinally extending recesses to facilitate removing the container from the nested position.

BRIEF DESCRIPTION OF THE DRAWINGS

FIG. 2 is a side elevational view of the container and lid assembly shown in FIG. 1;

FIG. 6 is a top plan view of the container with the closure and lid assembly removed therefrom;

FIG. 7 is a fragmentary longitudinal cross-section view, partly in side elevation, and showing containers, in phantom, in nested relationship; and FIG. 8 is a fragmentary, longitudinal sectional view through the handle of a container, taken substantially along line 8—8 of FIG. 6.

DESCRIPTION OF THE PREFERRED EMBODIMENT

Figure 1:
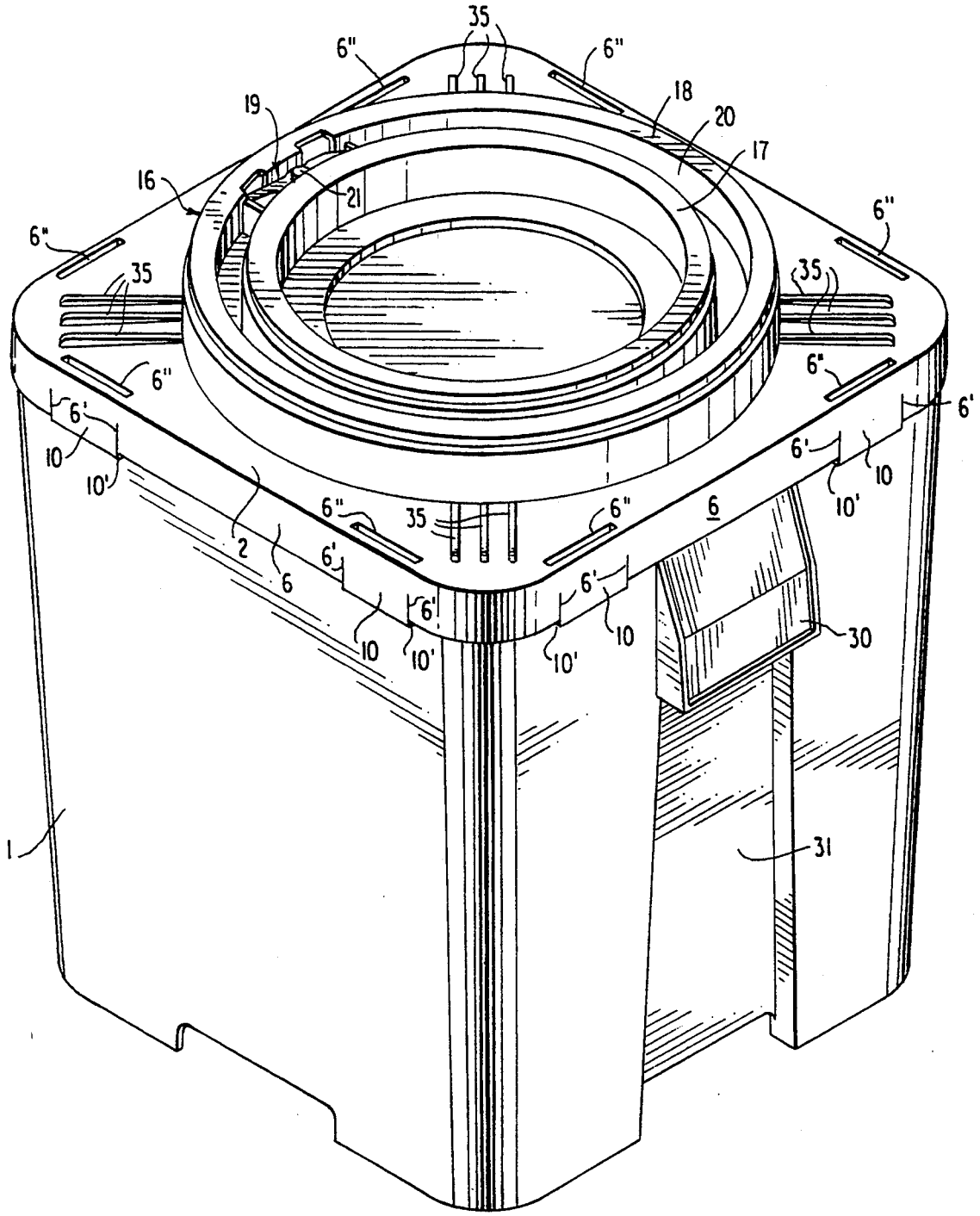
FIG. 1 is a perspective view of the container and lid assembly of the present invention.
Figure 3:
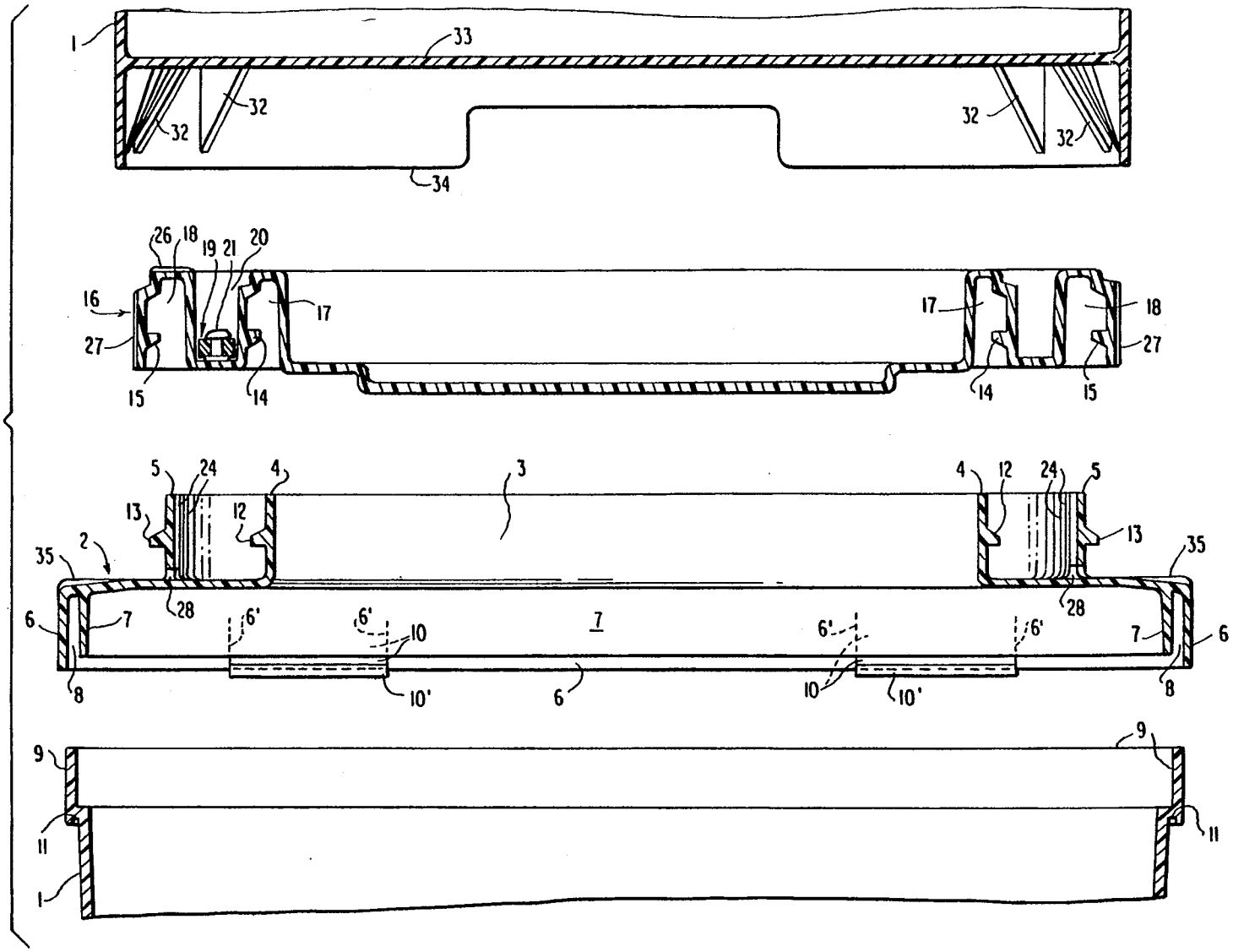
FIG. 3 is an exploded, fragmentary, sectional view showing the top edge portion of the container, the container closure, the lid and associated locking member, and the bottom of another stacked container.

Referring to the drawings in greater detail, and more particularly to FIGS. 1 and 3, the container and lid assembly of the present invention comprises, a rectangular container 1 having a rectangular closure 2 provided with a central circular opening 3 surrounded by a pair of radially spaced annular walls 4.and 5. The closure 2 is provided with a depending skirt portion 6 extending around the periphery thereof and a depending peripheral wall 7 spaced inwardly from the skirt portion 6 to provide a tapered channel 8 for receiving the upper edge portion 9 of the container 1, as shown in FIG. 5.

The skirt portion 6 of the rectangular closure 2 is provided with a plurality of peripherally spaced resilient fingers 10, FIGS. 1, 2 and 5, having hook-like ends 10' depending below the lower edge of skirt portion 6, and adapted to engage within a groove 11, FIGS. 3 and 5, formed between the container 1 and the upper edge portion 9 thereof, whereby the closure 2 is tightly and releasably snapped onto the container 1. Thin vertical cuts 6' through skirt portion 6 separate the sides of fingers 10 from the skirt portion 6 and render the fingers resilient. Slot openings 6'' are provided in the top of rectangular closure 2 to accommodate a mold part for forming the hooklike ends 10' on resilient fingers 10, during the molding process for rectangular closure 2.

The annular walls 4 and 5 are provided with radially outwardly extending coordinated threads 12 and 13 which cooperate, respectively, with a pair of inwardly extending coordinated threads 14 and 15 provided on a lid 16. The teeth 14 and 15 are contained in downwardly extending radially spaced channels 7 and 18 formed in the lid 16, which receive the radially spaced annular walls 4 and 5 on the closure 2 when the lid 16 is threaded onto the closure, as shown in FIG. 5.

Figures 4, 5:
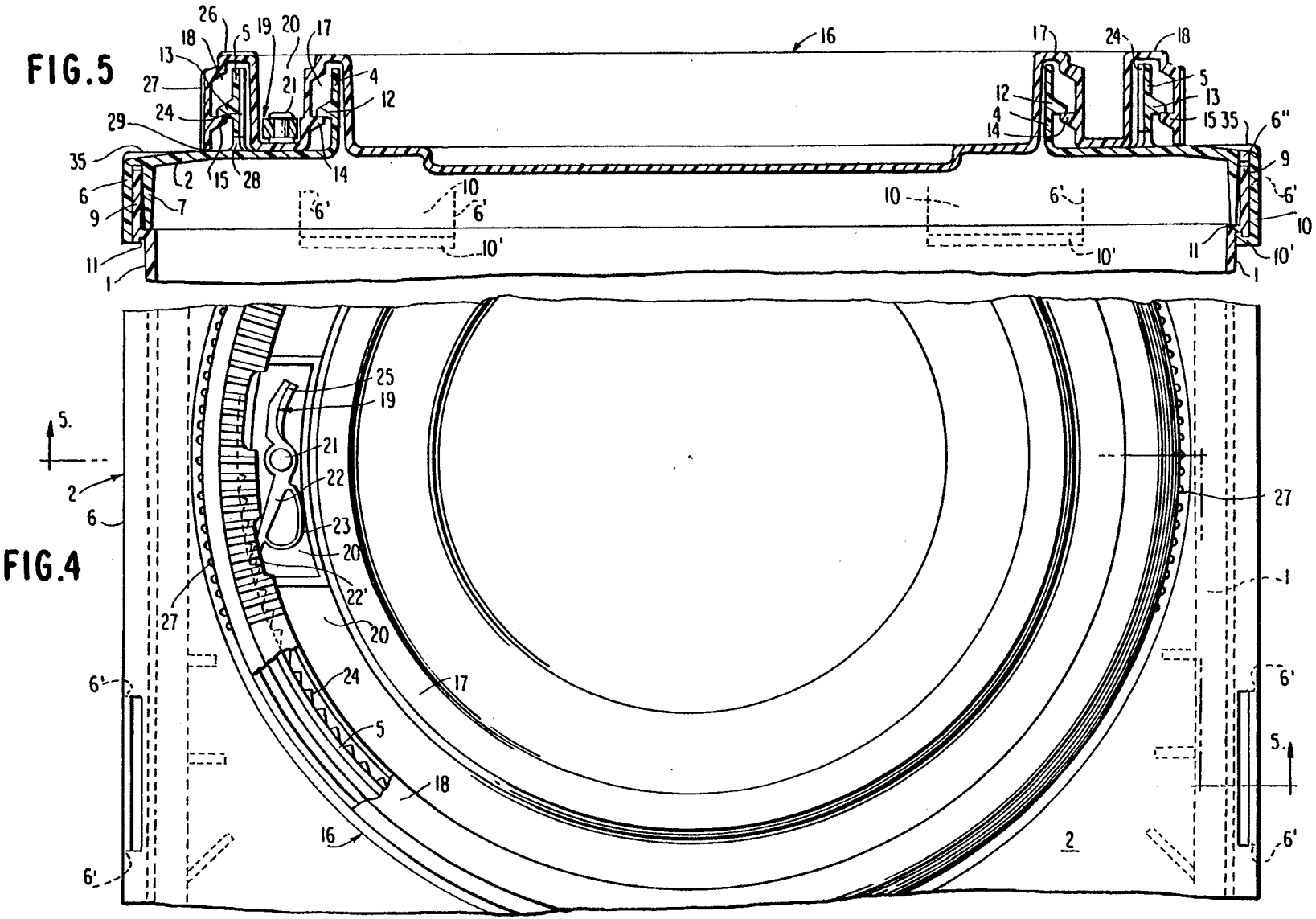
FIG. 4 is a fragmentary, top elevational view of the container and lid assembly shown in FIG. 1.
FIG. 5 is a cross-sectional view taken substantially along line 5—5 of FIG. 4.

As will be seen in FIGS. 4 and 5, a resiliently biased locking member 19, of the type disclosed in my aforementioned patents, is positioned in the space 20 between the channels 17 and 18, and pivotally connected as at 21 to the lid 16. The locking member 19 includes a lever arm 22 biased by an arcuate spring member 23, and extending through an aperture 22' in the inner side wall of channel 18 into engagement with a plurality of teeth 24 provided on the inner surface of the outer wall 5, to thereby lock the lid 16 onto the closure 2. The locking lever 19 is also provided with a thumb engaging portion 25 for moving the lever arm 22 in a counter-clockwise direction away from engagement with the teeth 24, whereby the lid 16 can be manually unscrewed from the closure 2.

To facilitate the manipulation of the lid 16 onto and off of the closure 2, the lid 16 is provided with corrugated surfaces as at 26 and 27 to thereby provide gripping surfaces.

A drain hole 28, FIG. 5, is provided at the base of the outer annular wall 5 and communicates with the atmosphere through a space 29 provided between the lower edge of the outermost skirt portion of the lid 16 and the top surface of the closure 2. If rain water or the like accumulates in the space 20 between the channels 17 and 18 around the locking member 19, it drains out through locking member aperture 22; and the aperture adjacent thumb engaging portion 25, into the space between spaced annular walls 4 and 5, through drain holes 28 in outer annular wall 5 and through the space 29 beneath the lower edge of the skirt portion of lid 16. This prevents any liquid from getting to the contents of the container when it is used.

As will be seen in FIGS. 1, 2, 7 and 8, the side walls of the containers are tapered to facilitate nesting empty containers for shipment, or the like. Two opposite side walls of containers 1 ace provided with integral handles 30 aligned with a longitudinally extending recess 31. When stacked, the bottom edge of the handle 30 of the top container contacts the upper edge 9 of the next adjacent lower container. By providing the recesses 31 in the container side walls, the contact surface area is reduced between nesting containers, as shown in FIG. 7, and an air passage is provided to thereby facilitate removing the containers from the nested position.

To complete the structural description of the container and lid assembly of the present invention, as will be seen in FIGS. 3 and 6, snort diagonal side webs 32 provided along the peripheral edge portion of the container 1 and integral with the bottom 33 of the container for centering the container on top of the lid 16 of the next adjacent lower container when stacking. When assembled containers are stacked on top of one another, the bottom edge 34 of the top container 1 rests on the flat reinforced ribs 35 of the top of closure 2 of the bottom container, as shown in FIG. 3.

From the above description it will be appreciated by those skilled in the art, that the construction and arrangement of the container 1 and lid assembly 16 of the present invention provide a container configured to maximize use of pallet space, and having a lid assembly positioned inwardly of the side walls of the container so that when placing a plurality of containers in side-by-side relationship, or when stacking the containers, the lid assembly 16 on each container is spaced inwardly from the side wall of the adjacent container, to thereby prevent damage to the lid assembly by the adjacent container during shipment and storage. A relatively large central circular opening for the container can be provided with this construction, which is protected by a child resistant lid assembly. Furthermore, the taper of the side walls of the containers facilitate nesting empty containers, and the longitudinal recesses 31 formed in the walls of each container 1 beneath integral handles facilitate sliding the empty inner container outwardly from the empty outer container because the contact wall surface area between adjacent containers is reduced, thereby reducing the functional resistance to sliding movement between the containers. When full or when the closure 2 and lid assembly 16 are placed on the containers 1, the container can be stacked and the diagonal webs 32 center the container on top to straddle the lid on the next adjacent lower container, and the bottom edge 34 of the container on top rests on a reinforced area 35 on the closure 2 of the next adjacent lower container.

The terms and expression which have been employed herein are used as terms of description and not of limitation, and there is no intention, in the use of such terms and expressions, of excluding any equivalents of the features shown and described or portions thereof, but it is recognized that various modifications are possible within the scope of the invention claimed.

I claim:

1. A space saving rectangular container having a child resistant lid assembly comprising, a rectangular container having a rectangular open end, a rectangular closure removably connected to the open end of said container, a central opening provided in said closure, a lid removably mounted on said closure for closing said opening, said closure provided with a pair of radially spaced annular walls surrounding said opening, threads provided on at least the outer annular wall of said pair of annular wails cooperating with threads provided on said lid, whereby the lid is threadably connected to said closure, and a resiliently biased locking member movably connected on said lid and engageable with a portion of the closure to secure the lid to the opening in the closure, whereby, when a plurality of the containers are selectively stacked or placed in side-by-side relationship, the lid and associate locking member on each container are positioned inwardly from the side wall of an adjacent container, thereby preventing damage to the lid and associated locking member by the adjacent container during shipment and storage.

2. A container and lid assembly according to claim 1, wherein the upper edge portion of the container is provided with a downwardly directed groove, the closure having a skirt portion, a plurality of peripherally spaced resilient fingers provided in said skirt portion engageable with said downwardly directed groove, whereby the closure is releasably snapped onto the container.

3. A container and lid assembly according to claim 1, wherein a plurality of teeth are provided on the inner surface of the outer annular wall of said pair of spaced annular walls, said resiliently biased locking member engaging said teeth to secure the lid to the closure.

4. A container and lid assembly according to claim 3, wherein the locking member comprises a lever arm pivotally connected to the lid, a spring member biasing a free end of said lever arm into engagement with said teeth, a thumb engaging portion on the opposite end of said lever arm for moving said free end of the lever arm in a direction away from engagement with the teeth, whereby the lid can be manually unscrewed from the closure.

5. A container and lid assembly according to claim 1, wherein the side walls of the container are tapered to facilitate nesting empty containers, a longitudinally extending recess provided in at least one side wall of the containers, whereby the contact surface area between the side wall of nested containers is reduced, to thereby facilitate the sliding movement of the inner container relative to the outer containers when removing the inner container from the nested position.

6. A container and lid assembly according to claim 1, wherein a plurality of diagonal side webs are provided on the bottom of each container for centering the container on top of the lid on the next adjacent lower container when stacked.

7. A container and lid assembly according claim 1, including reinforced areas on the top of said closure outwardly of the outer annular wall of said pair of spaced annular walls, and each container having a bottom edge contacting and supported by said reinforced areas on the top of the closure on the next adjacent lower container when stacked.

8. A container and lid assembly according to claim 1, including drain means through said outer annular wall adjacent said closure.

9. A container having a child resistant lid assembly comprising, a container having a side wall and an open end, a closure removably connected to the open end of said container, a central opening provided in said closure, a pair of radially spaced annular walls on said closure surrounding said opening and positioned inwardly of the side wall of the container, threads provided on each of said annular walls, a lid having radially spaced threads cooperating with the threads on said pair of radially spaced annular walls to removably threadably connect said lid to said closure for closing said opening, and a resiliently biased locking member pivotally connected to said lid and engageable with a portion of the closure to secure the lid to the opening in the closure, whereby the lid and associate locking member and pair of spaced annular walls on said closure are positioned inwardly from the side wall of the container.

10. A container and lid assembly according to claim 9, wherein said open end of said container has an upper edge portion provided with a groove, the closure having a skirt portion, a plurality of peripherally spaced resilient fingers provided in said skirt portion engageable with said groove, whereby the closure is releasably snapped onto the container.

11. A container and lid assembly according to claim 9, including reinforced areas on the top of said closure outwardly of the outer annular wall of said pair of spaced annular walls, and each said container having a bottom edge contacting and supported by said reinforced areas on the top of the closure on the next adjacent lower container when stacked.

12. A container and lid assembly according to claim 9, wherein the side wall of the container is tapered to facilitate nesting empty containers, a longitudinally extending recess provided in at least one side of said side wall of the containers, handles integrally connected to opposite sides of the container side wall, said handles having bottom portions adapted to contact the open end of the next adjacent lower container when nesting empty containers, whereby the contact surface area between the side wall of nested containers is reduced, to thereby facilitate the sliding movement of the inner container relative to the outer containers when removing the inner container from the nested position.

13. A container and lid assembly according to claim 9, in which said pair of radially spaced annular walls are integral with and extend upwardly from said closure.

14. A container and lid assembly according to claim 9, wherein a plurality of teeth are provided on the inner surface of the outer annular wall of said pair of spaced annular walls, said resiliently biased locking member engaging said teeth to secure the lid to the closure.

15. A container and lid assembly according to claim 14, wherein the locking member comprises a lever arm pivotally connected to the lid, a spring member biasing a free end of said lever arm into engagement with said teeth, a thumb engaging portion on the opposite end of said lever arm for moving said free end of the lever arm in a direction away from engagement with the teeth, whereby the lid can be manually unscrewed from the closure.

16. A container and lid assembly according to claim 14, including drain means through said outer annular wall adjacent said closure.

17. A rectangular container having a child resistant lid assembly comprising, a rectangular container having side walls and a rectangular open end, a rectangular closure removably connected to the open end of said container, a central opening provided in said closure, a pair of radially spaced annular walls on said closure surrounding said opening and positioned inwardly of the side walls of the container, threads provided on each of said annular walls, a lid having radially spaced threads cooperating with the threads on said pair of radially spaced annular walls to removably threadably connect said lid to said closure for closing said opening, and a resiliently biased locking member pivotally connected to said lid and engageable with a portion of the closure to secure the lid to the opening in the closure, whereby the lid and associate locking member and pair of spaced annular walls on said rectangular closure are positioned inwardly from the side walls of the rectangular container.

18. A container and lid assembly according to claim 17, wherein a plurality of teeth are provided on the inner surface of the outer annular wall of said pair of spaced annular walls, said resiliently biased locking member engaging said teeth to secure the lid to the rectangular closure.

19. A space saving rectangular container having a child resistant lid assembly comprising, a rectangular container having a rectangular open end, a rectangular closure removably connected to the open end of said container, a central opening provided in said closure, a lid removably mounted on said closure for closing said opening, said closure provided with a pair of radially spaced annular walls surrounding said opening, threads provided on said annular walls cooperating with threads provided on said lid, whereby the lid is threadably connected to said closure, and a resiliently biased locking member movably connected on said lid and engageable with a portion of the closure to secure the lid to the opening in the closure, whereby, when a plurality of the containers are selectively stacked or placed in side-by-side relationship, the lid and associate locking member on each container are positioned inwardly from the side wall of an adjacent container, thereby preventing damage to the lid and associated locking member by the adjacent container during shipment and storage.

20. A container having a child resistant lid assembly comprising, a container having a side wall and an open end, a closure removably connected to the open end of said container, said closure having a top wall and a central opening provided in said top wall, a pair of radially spaced annular walls on said top wall surrounding said opening and positioned inwardly of the side wall of the container, threads provided on at least one of said annular walls, a lid having threads cooperating with the threads on said at least one of said pair of radially spaced annular walls to removably threadably connect said lid to said closure for closing said opening, a resiliently biased locking member pivotally connected to said lid and engageable with a portion of the closure to secure the lid to the opening in the closure, said open end of said container having an upper edge portion provided with a downwardly directed groove, the closure having a skirt portion, a plurality of peripherally spaced resilient fingers provided in said skirt portion having inwardly turned hook portions engageable with said downwardly directed groove, and a plurality of peripherally spaced slots through the top wall adjacent said skirt portion and said respective plurality of peripherally spaced resilient fingers, whereby the inwardly turned hook portions can be formed on said resilient fingers and the lid and associate locking member and pair of spaced annular walls on said closure are positioned inwardly from the side wall of the container.

21. A container and lid assembly according to claim 20, in which said pair of radially spaced annular walls are integral with and extend upwardly from said top wall of said closure.

22. A container and lid assembly according to claim 20, wherein a plurality of teeth are provided on the inner surface of the outer annular wall of said pair of spaced annular walls, said resiliently biased locking member engaging said teeth to secure the lid to the closure.

23. A container and lid assembly according to claim 22, wherein the locking member comprises a lever arm pivotally connected to the lid, a spring member biasing a free end of said lever arm into engagement with said teeth, a thumb engaging portion on the opposite end of said lever arm for moving said free end of the lever arm in a direction away from engagement with the teeth, whereby the lid can be manually unscrewed from the closure.

24. A container and lid assembly according to claim 22, wherein an aperture is provided in said lid opening into the space between said pair of radially spaced annular walls, and said resiliently biased locking member extending through said aperture interior of said lid into engagement with said teeth.

25. A container and lid assembly according to claim 24, including drain means through said outer annular wall adjacent said closure, whereby liquid will drain from the space between said pair of radially spaced annular walls.

26. A space saving rectangular container having a child resistant lid assembly comprising, a rectangular container having a rectangular open end, a rectangular closure connected to the open end of said container, a central opening provided in said rectangular closure, a lid removably mounted on said rectangular closure for closing said opening, a biased locking portion movably connected on said lid and engageable with a portion of the rectangular closure to secure the lid to the opening in the closure, said rectangular closure includes a substantially horizontal top wall portion above the open end of said rectangular container, said top wall portion provided with a pair of radially spaced annular walls surrounding said central opening and positioned inwardly of the said wall of the container, threads provided on at least one of said annular walls of said pair of annular walls cooperating with threads provided on said lid, whereby the lid is threadably connected to said closure, cooperating locking means on at least one of said annular walls, and said biased locking portion on said lid movably engageable and disengageable with said cooperating locking means, whereby, when a plurality of the containers are selectively stacked or placed in side-by-side relationship, the lid and associate locking portion on each container are positioned inwardly from the side wall of an adjacent container, thereby preventing damage to the lid and associated locking portion by the adjacent container during shipment and storage.

27. A container and lid assembly according to claim 26, wherein the upper edge portion of the rectangular container is provided with a downwardly directed external groove, said rectangular closure having a skirt portion, a plurality of peripherally spaced resilient fingers provided in said skirt portion engageable with said downwardly directed external groove, whereby the rectangular closure is releasably snapped onto the rectangular container.

28. A space saving rectangular container having a child resistant lid assembly comprising, a rectangular container having a rectangular open end, a rectangular closure connected to the open end of said container, a central opening provided in said rectangular closure, a lid removably mounted on said rectangular closure for closing said opening, a biased locking portion movable connected on said lid and engageable with a portion of the rectangular closure to secure the lid to the opening in the closure, said rectangular closure includes a substantially horizontal top wall portion above the open end of said rectangular container, reinforced areas on said top wall in corner portions of said rectangular closure extending outwardly of the lid, and each rectangular container having a bottom rectangular edge contacting and supported by said corner portion reinforced arenas on the top wall of the rectangular closure on the next adjacent lower rectangular container when stacked, whereby, when a plurality of the containers are selectively stacked or placed in side-by-side relationship, the lid and associate locking portion on each container are positioned inwardly from the side wall of an adjacent container, thereby preventing damage to the lid and associated locking portion by the adjacent container during shipment and storage.

* * * * *